US011040378B2

(12) United States Patent
Trebbi

(10) Patent No.: US 11,040,378 B2
(45) Date of Patent: Jun. 22, 2021

(54) DOSING APPARATUS FOR POWDER PRODUCTS

(71) Applicant: I.M.A. INDUSTRIA MACCHINE AUTOMATICHE S.P.A., Ozzano dell'Emilia (IT)

(72) Inventor: Claudio Trebbi, Ozzano dell'Emilia (IT)

(73) Assignee: I.M.A. INDUSTRIA MACCHINE AUTOMATICHE S.P.A., Ozzano dell'Emilia (IT)

( * ) Notice: Subject to any disclaimer, the term of this patent is extended or adjusted under 35 U.S.C. 154(b) by 325 days.

(21) Appl. No.: 16/302,887

(22) PCT Filed: May 22, 2017

(86) PCT No.: PCT/IB2017/052996
§ 371 (c)(1),
(2) Date: Nov. 19, 2018

(87) PCT Pub. No.: WO2017/203412
PCT Pub. Date: Nov. 30, 2017

(65) Prior Publication Data

US 2019/0299258 A1 Oct. 3, 2019

(30) Foreign Application Priority Data

May 23, 2016 (IT) ..... 102016000052717

(51) Int. Cl.
*B08B 3/12* (2006.01)
*B65B 1/12* (2006.01)

(52) U.S. Cl.
CPC ..... *B08B 3/123* (2013.01); *B08B 3/12* (2013.01); *B65B 1/12* (2013.01); *B08B 2209/005* (2013.01); *B65B 2210/06* (2013.01)

(58) Field of Classification Search
None
See application file for complete search history.

(56) References Cited

U.S. PATENT DOCUMENTS 2,907,455 A * 10/1959 Sasaki ..... B03D 1/02 209/5
3,982,789 A * 9/1976 Funk ..... B65G 53/30 406/105

(Continued)

FOREIGN PATENT DOCUMENTS

CN 102489463 6/2012
CN 204817320 12/2015

(Continued)

OTHER PUBLICATIONS

Japanese Office Action dated Dec. 3, 2019 in corresponding Japanese Patent Application No. 2018-561494 with partial English translation. 3 Pages.

(Continued)

*Primary Examiner* — Eric W Golightly
*Assistant Examiner* — Arlyn I Rivera-Cordero
(74) *Attorney, Agent, or Firm* — Wenderoth, Lind & Ponack, L.L.P.

(57) ABSTRACT

A dosing apparatus for dosing a powder product inside containers includes a hopper provided with an inner cavity for containing the product, a lower portion provided with a supply duct with a terminal aperture for the outflow of the product, a metering screw rotating inside the supply duct and a washing manifold provided with an inlet opening and containing at least a sonotrode. In a cleaning configuration of the dosing apparatus, the washing manifold is connected to the hopper coupling the inlet opening to the supply duct, so as to receive and contain a washing liquid introduced in the hopper. The sonotrode is activated to produce alternate pressure waves capable of generating in the washing liquid (Continued)

air bubbles adapted to propagate towards the inner cavity through the supply duct, and to implode thus creating shock waves.

19 Claims, 2 Drawing Sheets

(56) References Cited

U.S. PATENT DOCUMENTS

| | | | | |
|---|---|---|---|---|
| 5,988,234 | A | 11/1999 | Wegman | |
| 2006/0191424 | A1 | 8/2006 | McLoughlin et al. | |
| 2006/0283328 | A1 | 12/2006 | Saiki et al. | |
| 2010/0154819 | A1* | 6/2010 | Doglioni Majer | C02F 5/025 134/1 |
| 2010/0192988 | A1 | 8/2010 | Saiki et al. | |
| 2011/0135534 | A1 | 6/2011 | Bates et al. | |
| 2012/0237304 | A1* | 9/2012 | Zarnescu | F23K 3/02 406/181 |

FOREIGN PATENT DOCUMENTS

| | | |
|---|---|---|
| DE | 102008021971 | 11/2009 |
| DE | 102012210346 | 12/2013 |
| EP | 1 736 217 | 12/2006 |
| EP | 1 951 449 | 10/2015 |
| JP | 2004-338806 | 12/2004 |
| JP | 2008-529767 | 8/2008 |
| JP | 2011-522683 | 8/2011 |
| WO | 2007/059632 | 5/2007 |
| WO | 2009/133106 | 11/2009 |

OTHER PUBLICATIONS

International Search Report dated Sep. 6, 2017 in International (PCT) Application No. PCT/IB2017/052996. 3 Pages.

Office Action dated Oct. 9, 2020 in corresponding Chinese Patent Application No. 201780031131.8, with English translation 5 pages.

* cited by examiner

DOSING APPARATUS FOR POWDER PRODUCTS

BACKGROUND

Field

The invention relates to apparatuses for dosing products inside containers and in particular it relates to a dosing apparatus arranged for dosing, in an automatic packaging machine, a powder product inside containers and capable of being easily washed and sterilized. The invention also relates to a method for cleaning, in particular washing, the aforesaid dosing apparatus.

Description of the Related Art

In the automatic packaging machines known and used in the pharmaceutical, cosmetics and food sectors for filling containers with powder products, the use of dosing apparatuses of the volumetric type provided with a metering screw or Archimede's screw arranged to take the product out of a reservoir, or a hopper, and to dose it inside containers is known. The metering screw has in fact one helicoidal groove along a respective longitudinal development axis, that defines a pass-through cylindrical duct, wherein said metering screw is inserted with a little play, one cavity for containing and moving the product, having a precise and established volume for unit of length or pace. Thereby, by rotating the metering screw about the longitudinal axis of a determined angle, it is possible to move ahead for a corresponding stroke, a defined and precise dose of product which outflows through a terminal aperture of the cylindrical duct and falls inside the underlying container.

The sizes and the shape of the metering screw (internal and external diameters, pace of the helicoidal groove) are selected according to the dosage to be carried out in the containers and the type of powder product to dose.

The rotation motion of the metering screw is usually intermittent and coordinated with the forwarding motion of the containers in the packaging machine.

The metering screw is set to rotate, directly or by interposition of a speed reducer unit, by a rotary engine, usually electric, arranged inside the dosing apparatus or the packaging machine.

Inside the hopper a mixing element rotating around the metering screw may be provided, that provides to mix and make more sliding the powder product that the metering screw takes out and conveys outwardly through the pass-through cylinder duct.

In the case of pharmaceuticals packaging, in particular for parenteral use, it is necessary as well as required by the pharmaceutical rules, that all the elements, components, parts and surfaces of the dosing apparatus that are in contact with the product (metering screw, cylindrical duct, hopper, mixing element, etc) are perfectly clean and sterilized in order not to prejudice the sterility of the dosing and packaging process. To this end, after each production lot, the dosing apparatus must be duly washed and sterilized, in particular in order to remove each residue or trace of the previously packed product.

Typically the dosing apparatus is detached from the packaging machine and separated from it, where it is dismounted in its single parts and components that can thus be washed and sterilized separately. Once washed and sterilized, the dosing apparatus is then mounted again on the packaging machine.

However, these procedures are very complicated, laborious and time consuming, especially if the packaging machine is provided with a containment insulator sealingly separating from a surrounding external environment, a volume inside the machine wherein the filling and packaging process occur, such volume having to stay integral and isolated even during the dismounting/mounting procedure of the dosing apparatus.

In order to solve such a drawback, in-place washing and sterilization systems and procedures are known, so called OP/SIP (Clean-In-Place/Sterilization-In-Place) processes providing the input of washing and sterilization fluids in sequence inside the dosing apparatus mounted on the machine. However these results are effective in case of dosing apparatuses for liquid products, since in the case of powder products, though they are watersoluble, due to the presence of elements with peculiar geometries and shapes as metering screws and mixers, the simple input of washing/sterilization fluids does not guarantee the necessary cleansing and sterility and in particular the total removal of residues and traces of product.

In fact, while in function, the powder products tend to accumulate and agglomerate, adhering to the surfaces of the parts and components of the apparatus, in particular inside the helicoidal grooves of the dosing metering screws. Furthermore, especially in case of small sizes metering screws for micro-dosage, due to the very small play between metering screw and respective cylindrical duct wherein it is inserted, the passage of the washing fluids is difficult and it is thus hard to obtain a proper and correct cleansing.

SUMMARY

An object of the present invention is improving the known dosing apparatuses that can be associated to an automated packaging machine for dosing a powder product inside containers.

Another object is implementing a dosing apparatus for powder products that can be cleaned, in particular washed, in a quick, complete and optimal way, with no need to be removed from the packaging machine and/or even partially dismounted, in particular subjected to an in-place washing process, so called CIP or WIP.

A further object is providing a dosing apparatus and a cleaning method that enable to completely remove the powder product from parts, elements and surfaces inside the apparatus, ensuring an accurate and complete washing.

In one first aspect of the invention a dosing apparatus according to claim 1 is provided.

In one second aspect of the invention a cleaning method for a dosing apparatus according to claim 9 is provided.

BRIEF DESCRIPTION OF THE DRAWINGS

The invention shall be better understood and implemented referring to the enclosed drawings showing an exemplary and non-limiting embodiment, wherein.

DETAILED DESCRIPTION

Figure 1:
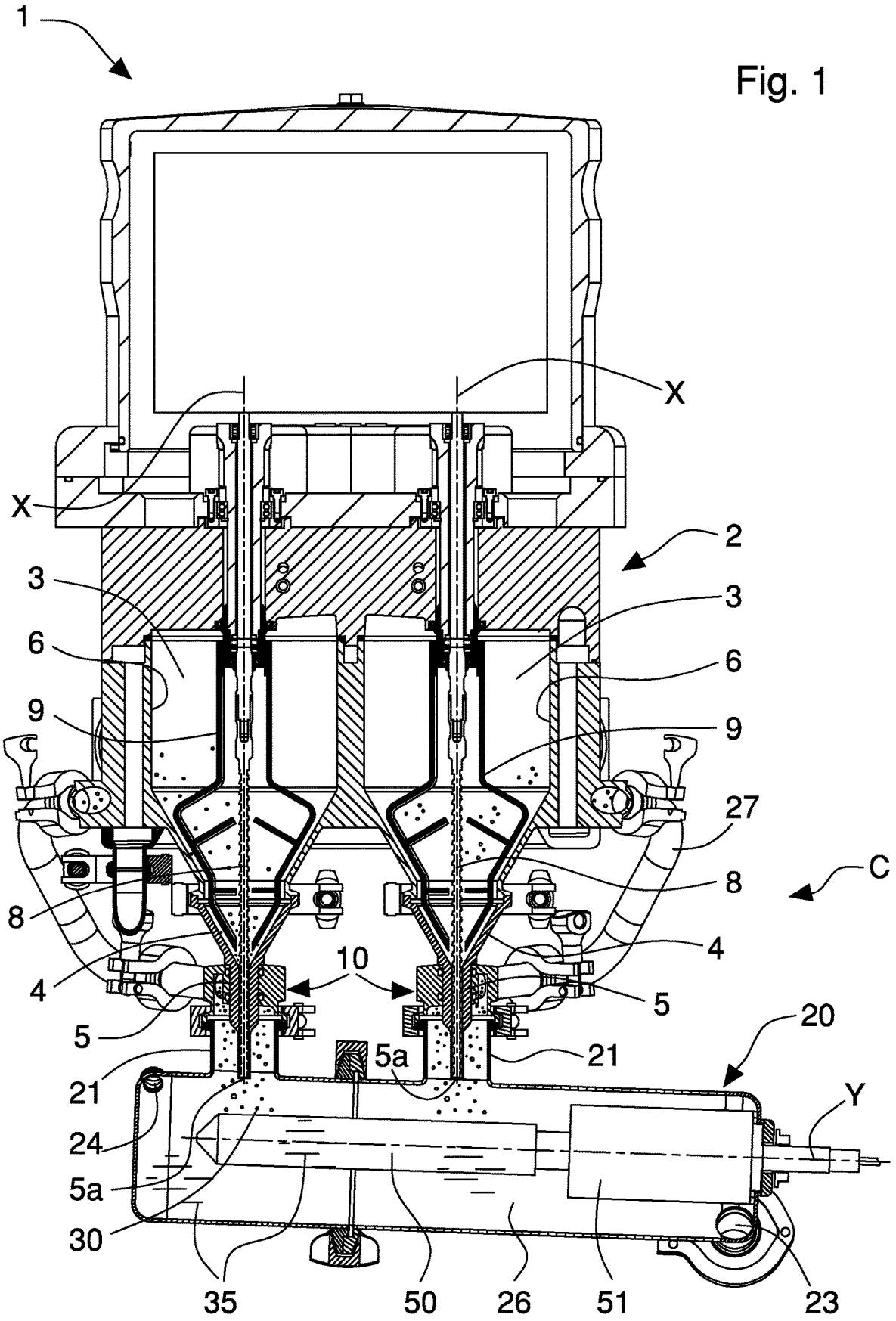
FIG. 1 is a cross-section of the dosing apparatus of the invention in a cleaning configuration.
Figure 3:
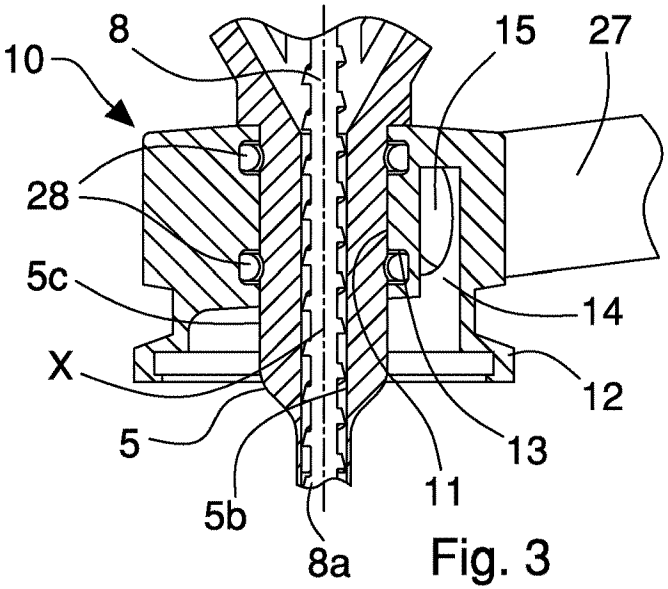
FIG. 3 is an enlarged section of a connecting element of the apparatus of FIG. 1.
Figure 2:
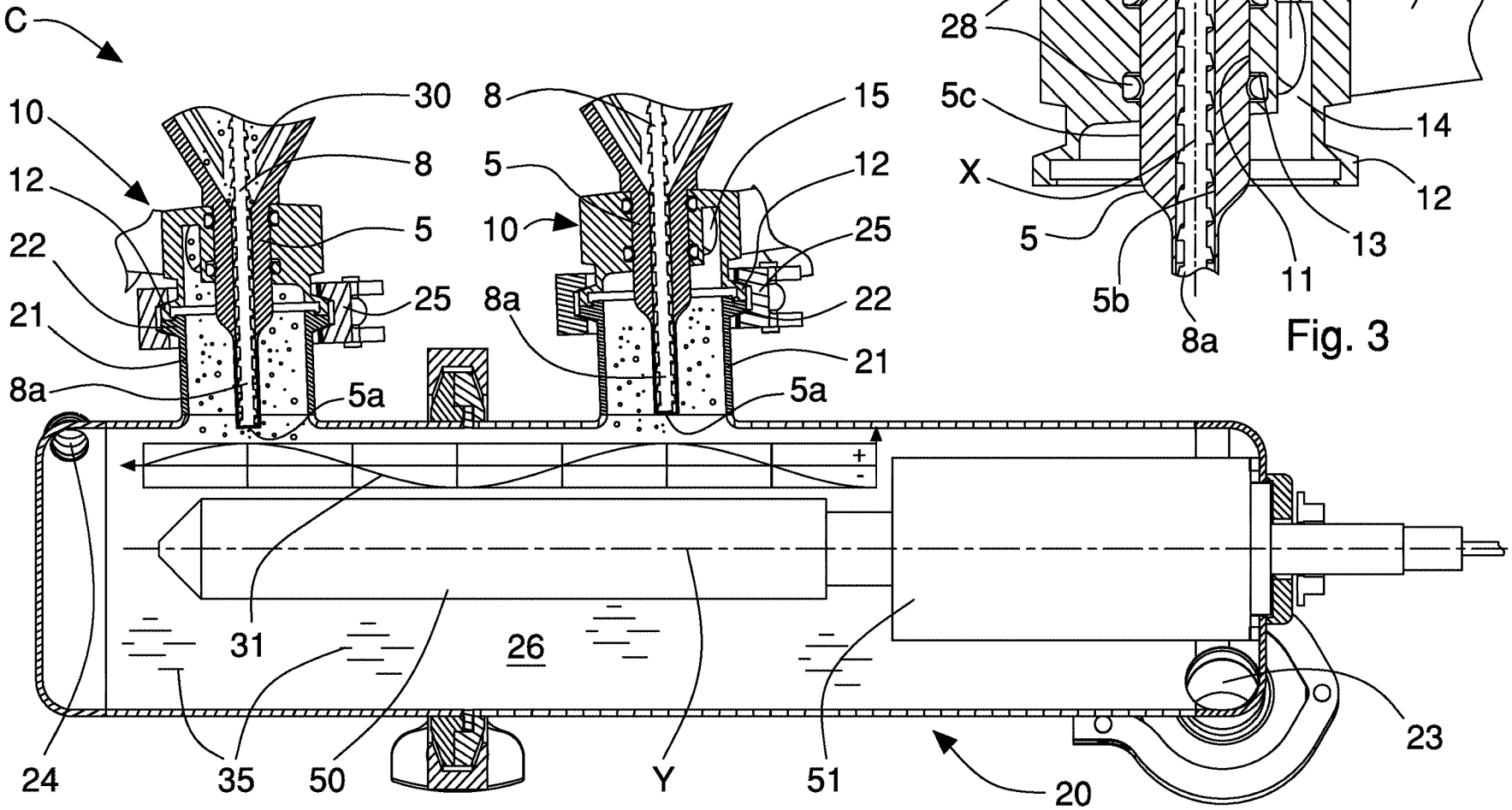
FIG. 2 is an enlarged detail of the apparatus of FIG. 1 illustrating in particular one washing manifold.

Referring to FIGS. 1 to 3, a dosing apparatus 1 is shown arranged for dosing a powder product inside containers in an automated packaging machine that can be used in the pharmaceutical, cosmetics or food sectors.

The dosing apparatus 1 comprises a hopper 2 provided with one or more inner cavities 3, for example two being adjacent and placed side by side, each of which is arranged to contain the powder product and comprises a lower portion 4 having a supply duct 5 with a terminal aperture 5*a* for the outflow of the product to be dispensed into a container.

The apparatus 1 also comprises one or more metering screws 8, for example two, each of which rotating about and extending along a respective rotation axis X inside a respective inner cavity 3 and a corresponding supply duct 5.

More precisely, each inner cavity 3 of the hopper 2 comprises an upper portion 6 having substantially cylindrical shape and the aforesaid lower portion 4 having substantially conical shape and converging towards the supply duct 5. The latter includes an internal pass-through seat 5*b*, in particular cylindrical, arranged to receive an operative end 8*a* of the corresponding metering screw 8 and cooperating with the latter for dosing the product inside containers.

Inside each inner cavity 3 of the hopper 2 a respective mixing element 9, of the known type and not herein described in detail, is also provided, which rotates about the corresponding metering screw 8, in particular co-axially to its rotation axis X, and which provides to mix the powder product and make it more sliding.

The dosing apparatus 1 also comprises a washing manifold 20 provided with one or more inlet openings 21, for example two, and equal in number to the number of metering screws 8 and of relative supply ducts 5, and containing in its interior a sonotrode 50 of the known type, not illustrated in detail in the figures.

In one cleaning configuration C of the dosing apparatus 1, the washing manifold 20 is connected to the hopper 2, in particular sealingly coupling the inlet openings 21 to the respective supply ducts 5, so as to receive and contain a washing liquid 35 introduced into the hopper 2, in a cleaning procedure that is better described in the following description.

The washing manifold has, for example, a substantially cylindrical elongated shape and comprises an inner compartment 26 arranged to contain the sonotrode 50. The latter can be activated in the cleaning procedure in order to generate, through alternate pressure waves 31 produced by the sonotrode 50 thereof, air or steam bubbles or cavities 30 of microscopic sizes in the washing liquid 35. The aforesaid air or steam bubbles or cavities 30 propagate towards the inner cavities 3 through the supply ducts 5 and are intended for detaching and/or breaking apart, by imploding, the residues of powder products that adhere to the internal surfaces of the dosing apparatus 1, in particular the surfaces of the metering screw 8, in its helicoidal groove.

A supply unit 51 is connected to the sonotrode 50 to transfer a oscillating power to the latter. In the illustrated embodiment, the supply unit 51 too is contained inside the washing manifold 20 and comprises a high frequency electric wave generator and a converter or transducer, for example of the piezoelectric type, which transforms the electric waves into ultrasonic mechanical oscillations or vibrations transmitted to the oscillating part that is the sonotrode 50. An amplifier or booster interposed between the converter and the sonotrode 50 and arranged for amplifying the width of the mechanical oscillations may also be provided. The sonotrode 50 ultrasonic mechanical vibrations generate the alternate pressure waves 31 in the washing liquid 35.

In order to removably couple each inlet opening 21 with the respective supply duct 5 in the cleaning configuration C, a corresponding connection element 10 is provided. The latter comprises a first seat 11 arranged to sealingly receive a respective supply duct 5 and a first coupling portion 12 adapted to abut a second coupling portion 22 of a corresponding inlet opening 21 of the washing manifold 20. The first seat 11 substantially comprises a pass-through cylindrical cavity provided with one or more second annular seats 13 capable of housing respective sealing gaskets 28 arranged to elastically abut an external wall 5*c* of the supply duct 5 so as to sealingly insulate the inside of the washing manifold 20 and thus of the hopper 2 in the external environment, when the supply duct 5 is inserted in the first seat 11 thereof and the connecting element 10 is fixed to the inlet opening 21.

The first and second coupling portions 12, 22 form, for example, a known connection of the "Tri-clamp" type and are mutually reversibly lockable through a closing clamp 25. The connecting element 10 also comprises a collecting compartment 14 substantially arranged around the first seat 11 and provided with an outlet opening 15 for the air bubbles 30, which is connectable, in the cleaning configuration C, to the inner cavities 3 of the hopper 2 via a connecting tube 27.

The washing manifold 20 comprises a first discharge opening 23 for the outflow of the washing liquid 35 during and/or after the washing procedure of the dosing apparatus 1 and one second discharge opening 24 for the outflow of the air possibly present in the washing manifold 20 during one filling step thereof with the washing liquid 35. To this end, the first discharge opening 23 is made at the lower end of the washing manifold 20, substantially opposite to the inlet openings 21 so as to allow the complete outflow of the liquids by gravity from the washing manifold 20 mounting the latter on the hopper 2 with an inclination comprised between 1° and 5°, in particular 2°, with respect to a horizontal plane.

Differently, the second discharge opening 24 is formed at an upper end of the washing manifold 20 to enable (with the manifold mounted tilted) the air outflow and thus to prevent the formation of air bubbles or bags inside the washing manifold 20 thereof during its filling with the washing liquid 35.

The sonotrode 50 and the power supply unit 51 connected thereof are completely inserted inside the inner compartment 26 of the washing manifold 20. In particular, the sonotrode 50 is arranged below the supply ducts 5 and has a longitudinal axis Y transverse to the rotation axis X of the metering screw 8. Preferably, the sonotrode 50 is arranged with its own longitudinal axis Y lying on a vertical plane passing through the rotation axis X of the metering screw 8. In the preferred embodiment shown in the figures including two metering screws 8, the longitudinal axis Y of the sonotrode 50 lies on a vertical plane passing through the rotation axis X of the two metering screws 8. In general, for dosing apparatuses comprising a plurality of metering screws 8 and a corresponding plurality of inlet openings 21, such metering screws 8 and inlet openings 21 are arranged above the sonotrode 50, aligned along the longitudinal axis Y of the sonotrode 50 thereof.

The sonotrode 50 has such sizes and/or it is positioned inside the washing manifold 20 in such a way that the pressure waves 31 generated by it, oscillating with a sinusoidal motion along the longitudinal axis Y of the sonotrode 50, have positive pressure peaks at the inlet openings 21 and thus at the supply ducts 5 as illustrated in FIG. 2 and as better described in the following description.

The functioning of the dosing apparatus 1 of the invention provides, in a post-production cleaning or washing procedure, the connection of the washing manifold 20 to the hopper 2 in the cleaning configuration C of the FIGS. 1-3. Such connection is implemented coupling the supply ducts 5 of the hopper 2 to the respective inlet openings 21 of the washing manifold 20 through the connecting elements 10. The latter are sealingly connected to the inlet openings 21 coupling the respective first and second coupling portions 12, 22 and stuck shut them by means of a closing clamp 25.

The outlet openings 15 of the connecting elements 10 are thus connected to the inner cavity 3 of the hopper 2 through respective connecting tubes 27.

In one ultrasounds washing step the hopper 2 and the manifold are completely filled with a washing liquid 35. To this end, the first discharge opening 23 of the washing manifold 20 is closed, for example by a first respective valve, non illustrated, to avoid the outflow of the liquid, while the second discharge opening 24 is kept open for the time necessary to enable air to outflow from the washing manifold 20 and is thus closed by one respective second valve, not illustrated.

Once the filling with the washing liquid 35 has taken place and is completed, the sonotrode 50 is activated in order to produce, inside the washing manifold 20, alternate pressure waves 31 which generate in the washing liquid 35 by cavitation, air or steam bubbles or cavities 30 that propagate upwardly towards internal cavities 3 of the hopper 2 through the supply ducts 5. Air bubbles 30 are not stable and they implode within a short time generating localized high intensity shock waves that are able to detach and/or break apart residues and/or product agglomerates adhering to the internal surfaces of the dosing apparatus and in particular to the surfaces of the metering screws 8 and of the internal pass-through seat 5*b* of the supply duct 5.

It must be noted that the sizes and/or the position of the sonotrode 50 inside the washing manifold 20 are such that the pressure waves 31 generated by the sonotrode 50 thereof and oscillating with sinusoidal motion along a longitudinal axis Y of the latter have positive pressure peaks at the inlet openings 21 and therefore at the supply ducts 5. In other words, the metering screw 8 (and consequently the respective inlet openings 21) are arranged vertically above portions of the sonotrode 50 that generate positive pressure peaks of the pressure waves 31. Thereby, the cavitation effect and the air bubbles formation 30 are more intense at the aforesaid supply ducts 5 which are affected during the functioning by a significant flow of the aforesaid air bubbles 30.

The collecting compartment 14 inside each connecting element 10, connected through the outlet opening 15 and the connecting tube 27 to the inner cavity 3 of the hopper, prevents the formation, at the terminal opening 5*a* of the supply duct 5, of a barrier or cushion of air bubbles 30 which would prevent the latter ones from moving up through the internal pass-through seat 5*b*. More precisely, the collecting compartment 14 conveys a part of the air bubbles 30 towards the inner cavity 3, the remaining part thus being able to rise upwards through the supply duct 5. Inside the supply duct 5 a part of the air bubbles 30 implodes detaching and breaking apart, thanks to the shock waves generated this way, the residues of product possibly existing on the surfaces of the metering screw 8 and of the internal pass-through seat 5*b*. A remaining part of the air bubbles 30 further moves up along the supply duct 5 in the respective inner cavity 3 to implode affecting a central portion of the metering screw 8 and a terminal portion of the mixing element 9.

Similarly the air bubbles 30 that reach the inner cavity 3 through the connecting tube 27 affect and implode against the internal walls of the inner cavity 3 and against a central portion of the mixing element 9 thus contributing to detach and/or break apart the residues of product possibly existing of the surfaces of such elements.

In order to facilitate the rise along the supply duct 5 of the air bubbles 30 generated by the sonotrode 50, the respective metering screw 8 may be rotated about its own rotation axis X with a rotation direction opposite to the one used in the dosage of the product, that is such to push the air bubbles 30 towards the inner cavity 3.

In order to facilitate the implosion of air bubbles 30 generated in the washing liquid by the sonotrode 50, the hopper 2 and the washing manifold 20 are sealingly insulated from the external environment and subjected to an internal pressure higher than the atmospheric pressure.

After a predefined time lapse the sonotrode 50 is deactivated and the hopper 2 and the washing manifold 20 are emptied by opening the first discharge opening 23 of the manifold acting on the respective first valve.

The washing procedure may envisage, before the ultrasounds washing step, a preliminary washing step wherein the washing liquid is introduced inside the hopper 2, for example through one or more spray-balls, and is made flow through the inner cavities 3, the supply ducts 5 and the washing manifold 20 from which it outflows through the first discharge opening 23 of the manifold kept open by the first valve. The flow of washing liquid continues for a defined time lapse through the dosing apparatus 1 to remove the greatest part of the residual powder product after production is completed. In particular, such washing type enables to remove the product out of the internal cavities 3 of the hopper 2 and the greatest part of the product inside the helicoidal grooves of the metering screws 8.

Once the ultrasound washing step is over, other washing cycles or steps of the dosing apparatus 1 may be performed (for example conveying washing liquid through the aforesaid first discharge opening 23 of the manifold towards the hopper 2) in order to complete the washing procedure.

Once the washing procedure is completed, a sterilization procedure (SIP) may be carried out, for example through steam, by means of known ways and systems.

Thanks to the use of the washing manifold 20 internally provided with the sonotrode 50, the dosing apparatus 1 of the invention can thus be cleaned, in particular washed, in a quick, complete and optimal way with no need to be removed from the packaging machine and/or be dismounted even only partially. The washing manifold 20 in fact can be mounted rapidly and easily on the hopper 2, in particular introducing the supply ducts 5 into the first seats 11 of the respective connecting elements 10 hooked to the inlet openings 21 of the manifold 20. The connecting tubes 27 too are easily mounted connecting the outlet openings 15 of the connecting elements 10 to the internal cavities 3 of the hopper 2.

Demounting the washing manifold 20 from the hopper 2 is equally quick and easy.

The use of the sonotrode 50 allows to remove completely the powder product from parts, elements and surfaces inside the apparatus, in particular at the dosing metering screws and at the relative supply ducts, thus ensuring an accurate and complete washing.

In fact the sonotrode 50, when activated, generates in the washing liquid inside the manifold 20, alternate pressure waves 31, which generate, substantially by cavitation, air or steam bubbles or cavities 30. The air or steam bubbles or cavities 30 propagate in particular in the supply ducts 5 and, imploding therein, they create localized high intensity shock waves capable of detaching and/or breaking apart possible residues and/or product agglomerates adhering to the internal surfaces of the dosing apparatus and in particular to the surfaces of the metering screws 8 and of the internal pass-through seat 5*b* of the supply duct 5.

The method according to the invention for cleaning the above mentioned dosing apparatus 1 comprises the following steps:

connecting the washing manifold 20 to the hopper 2 by sealingly coupling a supply duct 5 of the latter to a respective inlet opening 21 of the washing manifold 20;

filling the hopper 2 and the washing manifold 20 with a washing liquid 35;

activating the sonotrode 50 inside the washing manifold 20 to produce alternate pressure waves 31 capable of generating in the washing liquid 35 air bubbles or cavities 30 that propagate towards the inner cavities 3 of the hopper 2 through the supply duct 5 and that, by imploding, create shock waves adapted to detach and/or break apart powder product residues and/or agglomerates adhering to internal surfaces of the dosing apparatus 1, in particular to the surfaces of the metering screws 8.

The method further provides that during the driving of the sonotrode 50, the hopper 2 and the washing manifold 20 are sealingly insulated from an external environment and set at an internal pressure higher than an atmospheric pressure to facilitate the implosion of said air bubbles 30.

During the driving of the sonotrode 50, rotating each metering screw 8 about its own rotation axis X in its respective supply duct 5 is also provided, so as to facilitate a moving upwards of the air bubbles 30 through the supply duct 5 towards the inner cavity 3.

The method also provides positioning the sonotrode 50 in the metering screw 8, before it is activated, in such a way that pressure waves generated by the sonotrode 50 and oscillating with sinusoidal motion along a longitudinal axis Y thereof have positive pressure peaks at the inlet opening 21 and at the supply ducts 5, in order to obtain a stronger formation of air bubbles 30 at the aforesaid supply ducts 5 and relative metering screws 8.

According to the method, making a washing liquid flow through the hopper 2 and the washing manifold 20 to washing and at least partially remove said residues of powder product before the filling is optionally provided.

The invention claimed is:

1. A method for cleaning a dosing apparatus comprising a hopper that is provided with an inner cavity for containing a powder product, the inner cavity including a lower portion provided with a supply duct with a terminal aperture for outflow of the powder product, and a metering screw that is adapted to rotate about, and extends along, a respective rotation axis inside the inner cavity and the supply duct, wherein a washing manifold has an inlet opening and an interior of the washing manifold contains at least one sonotrode that has a longitudinal axis transverse to the rotation axis of the metering screw, and wherein the washing manifold in a cleaning configuration of the dosing apparatus is connected to the hopper and the inlet opening is coupled to the supply duct, the method comprising:

connecting the washing manifold to the hopper by sealingly coupling the supply duct of the hopper to the inlet opening of the washing manifold;

filling the hopper and the washing manifold with a washing fluid;

activating the sonotrode inside the washing manifold to produce alternate pressure waves capable of generating air bubbles in the washing liquid that propagate towards the inner cavity of the hopper through the supply duct to implode creating shockwaves to detach and/or break apart powder product residue adhering to internal surfaces of the dosing apparatus.

2. The method according to claim 1, further comprising, at least during the activating of the sonotrode, rotating the metering screw in the supply duct so as to facilitate a moving up of the air bubbles through the supply duct towards the inner cavity.

3. The method according to claim 1, further comprising, before the activating of the sonotrode, positioning the sonotrode in the washing manifold such that the pressure waves generated by the sonotrode, oscillating with a sinusoidal motion along the longitudinal axis of the sonotrode, have positive pressure peaks at the inlet opening and the supply duct.

4. The method according to claim 1, further comprising, before the filling, making the washing fluid flow through the hopper and the washing manifold to wash and at least partially remove the powder product residue.

5. The method according to claim 4, wherein, during the activating of the sonotrode, the hopper and the washing manifold are sealingly isolated from an external environment and set at an internal pressure higher than an atmospheric pressure to facilitate implosion of the air bubbles.

6. A dosing apparatus for dosing a powder product inside containers, the dosing apparatus comprising:

a hopper that is provided with an inner cavity for containing the powder product, the inner cavity including a lower portion provided with a supply duct with a terminal aperture for outflow of the powder product; and a metering screw that is adapted to rotate about, and extends along, a respective rotation axis inside the inner cavity and the supply duct, wherein a washing manifold has an inlet opening and an interior of the washing manifold contains at least one sonotrode that has a longitudinal axis transverse to the rotation axis of the metering screw, wherein the washing manifold in a cleaning configuration of the dosing apparatus is connected to the hopper and the inlet opening is coupled to the supply duct, so as to receive and contain a washing liquid introduced into the hopper, and wherein the sonotrode is configured to produce alternate pressure waves capable of generating air bubbles in the washing liquid that propagate towards the inner cavity of the hopper through the supply duct to implode creating shockwaves to detach and/or break apart product residue adhering to internal surfaces of the dosing apparatus.

7. The dosing apparatus according to claim 6, wherein the washing manifold comprises an inner compartment arranged to contain at least the sonotrode, a first discharge opening at a lower end of the washing manifold for outflow of the washing liquid, the first discharge opening being substantially opposite to the inlet opening, and a second discharge opening formed at an upper end of the washing manifold to allow outflow of air from the washing manifold.

8. The dosing apparatus according to claim 1, further comprising a power supply unit connected to the sonotrode to transfer an oscillating power to the sonotrode, wherein the power supply unit is contained inside the washing manifold.

9. The dosing apparatus according to claim 6, wherein the sonotrode has dimensions or is positioned inside the washing manifold such that pressure waves generated by the sonotrode, oscillating with sinusoidal motion along the longitudinal axis of the sonotrode, have peaks of positive pressure at the inlet opening and the supply duct.

10. The dosing apparatus according to claim 1, wherein the sonotrode is arranged with the longitudinal axis lying on a vertical plane that passes through the rotation axis of the metering screw.

11. The dosing apparatus according to claim 1, wherein the metering screw is coaxial with the supply duct.

12. The dosing apparatus according to claim 1, wherein the hopper is provided with at least one additional inner cavity for containing the powder product, the at least one additional inner cavity including a lower portion provided with a supply duct with a terminal aperture for outflow of the powder product, the metering screw is a plurality of metering screws that can be rotated about, and extend along, respective rotation axes each within a respective one of the inner cavities and an associated one of the supply ducts of the hopper, and the washing manifold comprises at least one additional inlet opening, each of the inlet openings being couplable to a respective one of the supply ducts in the cleaning configuration.

13. The dosing apparatus according to claim 12, wherein the metering screws and the inlet openings are arranged above the sonotrode and aligned along the longitudinal axis of the sonotrode.

14. The dosing apparatus according to claim 6, further comprising a connecting element for removably coupling the inlet opening to the supply duct in the cleaning configuration.

15. The dosing apparatus according to claim 14, wherein the washing manifold comprises an inner compartment arranged to contain at least the sonotrode, a first discharge opening at a lower end of the washing manifold for outflow of the washing liquid, the first discharge opening being substantially opposite to the inlet opening, and a second discharge opening formed at an upper end of the washing manifold to allow outflow of air from the washing manifold.

16. The dosing apparatus according to claim 14, wherein the connecting element comprises a first seat for sealingly receiving the supply duct and a first coupling portion adapted to abut a second coupling portion of the inlet opening.

17. The dosing apparatus according to claim 16, wherein the washing manifold comprises an inner compartment arranged to contain at least the sonotrode, a first discharge opening at a lower end of the washing manifold for outflow of the washing liquid, the first discharge opening being substantially opposite to the inlet opening, and a second discharge opening formed at an upper end of the washing manifold to allow outflow of air from the washing manifold.

18. The dosing apparatus according to claim 16, wherein the connecting element further comprises a collecting compartment arranged around the first seat, the collecting compartment being provided with an outlet opening for the air bubbles, and wherein the outlet opening in the cleaning configuration is connectable to the inner cavity of the hopper.

19. The dosing apparatus according to claim 18, wherein the washing manifold comprises an inner compartment arranged to contain at least the sonotrode, a first discharge opening at a lower end of the washing manifold for outflow of the washing liquid, the first discharge opening being substantially opposite to the inlet opening, and a second discharge opening formed at an upper end of the washing manifold to allow outflow of air from the washing manifold.

* * * * *